US010765198B2

(12) United States Patent
Watne et al.

(10) Patent No.: US 10,765,198 B2
(45) Date of Patent: Sep. 8, 2020

(54) HAIR REMOVAL DEVICE

(71) Applicants: Patricia Watne, Orland Park, IL (US); Andrew Watne, Orland Park, IL (US)

(72) Inventors: Patricia Watne, Orland Park, IL (US); Andrew Watne, Orland Park, IL (US)

( * ) Notice: Subject to any disclaimer, the term of this patent is extended or adjusted under 35 U.S.C. 154(b) by 0 days.

(21) Appl. No.: 15/952,771

(22) Filed: Apr. 13, 2018

(65) Prior Publication Data

US 2019/0313780 A1 Oct. 17, 2019

(51) Int. Cl.

| | |
|---|---|
| ***A46B 9/02*** | (2006.01) |
| ***A46B 1/00*** | (2006.01) |
| ***A47K 3/28*** | (2006.01) |
| ***A46B 9/00*** | (2006.01) |
| ***A47K 7/02*** | (2006.01) |

(52) U.S. Cl.

CPC ..... *A46B 9/028* (2013.01); *A46B 1/00* (2013.01); *A46B 9/005* (2013.01); *A46B 9/025* (2013.01); *A47K 3/281* (2013.01); *A47K 7/02* (2013.01); *A46B 2200/1006* (2013.01)

(58) Field of Classification Search

CPC . A46B 9/005; A46B 9/028; A46B 2200/1006; A46B 2200/102; A46B 1/00; A47K 3/281; A47K 7/02; A47K 7/024; A46D 1/0253; A46D 1/0292; A46D 1/0238

USPC ..... 15/186–188, 167.3, 217; D4/136; D28/63

See application file for complete search history.

(56) References Cited

U.S. PATENT DOCUMENTS

| | | | | |
|---|---|---|---|---|
| 5,779,653 | A * | 7/1998 | Thompson | A47K 7/024 601/134 |
| 6,405,400 | B1 * | 6/2002 | McClain | A47K 7/026 15/160 |
| 7,407,142 | B1 | 8/2008 | Lopez | |
| D709,245 | S * | 7/2014 | Zenthoefer | D28/63 |
| 9,474,359 | B2 * | 10/2016 | Lopez | A46B 9/026 |
| 9,549,611 | B1 | 1/2017 | Bocangera | |
| 2016/0309886 | A1 | 10/2016 | Oldham | |

* cited by examiner

*Primary Examiner* — Laura C Guidotti

(74) *Attorney, Agent, or Firm* — James D Palmatier; Applied Patent Services, PC

(57) ABSTRACT

The Hair Removal Device may be a wall mounted assembly of spines or tentacles projecting outward from the wall and disposed to form a plurality of finger rows therebetween. The tentacles being a flexible, resilient material adapted to urge hair on a user's finger to engage a tentacle and release from the finger whereby the hair follicle is captured and retained until cleaned for proper disposal.

14 Claims, 2 Drawing Sheets

HAIR REMOVAL DEVICE

FIELD OF THE INVENTION

The Hair Removal Device relates to shower wall items used in personal bathing.

BACKGROUND OF THE INVENTION

Showers in common use consist essentially of a relatively smaller enclosure or stall which has a shower arm and head protruding from a wall, and which is closeable by a shower curtain or by a sliding or swinging door. Typically, an enclosure includes three walls (in the case of a lateral wall enclosure) or two walls (in the case of a corner enclosure) to define a showering/bathing area. The enclosure walls can be tiled or made of a water resistant material, such as glass or plastic. An opening to the enclosure is generally closed off by a door or curtain, which allows entry into the Enclosure while preventing water from splashing outside the enclosure.

While bathing hair from the user's head may become entangled on fingers and hands. It is usually most desirable to prevent the hair from going down the drain. Prior art devices try to catch the hair at the drain opening with a screen or filter. U.S. Pat. No. 9,549,611 B1 to Bocanegra provides a hair screen (62) attached to the wall to allow runoff from the hands to be screened on the way to the drain. The problem still remains for the hair twisted about the users fingers that must be removed.

Accordingly, there is a need for a device such as shower caddy that has a means to remove hair from a users hands and retain the hair for later disposal. Also, the new shower hair removal device should be easily manufactured and assembled. In addition, there is a need for a shower caddy that is portable or can be relocated and may accommodate hands of different sizes.

BRIEF DESCRIPTION OF THE PRESENT INVENTION

The Hair Removal Device comprises a plurality of hair grabbing clusters of spines or tentacles mounted in an array to accommodate the user dragging their hair laden fingers there through. The Hair Removal Device may have a base removably mounted on a shower wall having a water resistant body supporting the spines in a prearranged pattern. The spines may be formed from a latex or rubber type material having a flexibility while resiliently holding their manufactured shape. The spines may be mounted in clusters to provide flats between the clusters to help with hair removal and with cleaning the hair out for disposal. The spines may be oriented at a variety of angles to engage a users fingers at a predetermined angle to urge hair off of the hand.

The bottom side of the body may be adapted to attach to a smooth surface such as a tile or glass wall with suction cups. The mounting holds the Hair Removal Device in a position and at a predetermined height and orientation to be convenient for the user.

The Hair Removal Device may be mounted on a shower wall in a shower. The user, having hair on his hands may rub the hand over the Hair Removal Device placing the index finger in the index row, the middle finger in the middle row and the ring finger in the ring row. Spines projecting upward from the base and extending into the rows rub on the finger thus engaging hair follicles on the user's hand and retaining the follicles as the user removes his hand. The Hair Removal Device may be easily cleaned of the follicles for proper disposal.

The above description sets forth, rather broadly, the more important features of the present invention so that the detailed description of the preferred embodiment that follows may be better understood and contributions of the present invention to the art may be better appreciated. There are, of course, additional features of the invention that will be described below and will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

DETAILED DESCRIPTION OF THE INVENTION

In the following detailed description of the preferred embodiments, reference is made to the accompanying drawings, which form a part of this application. The drawings show, by way of illustration, specific embodiments in which the invention may be practiced. It is to be understood that other embodiments may be utilized and structural changes may be made without departing from the scope of the present invention. It is to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting. It should be appreciated that the invention can be used for any suitable.

Figure 1:
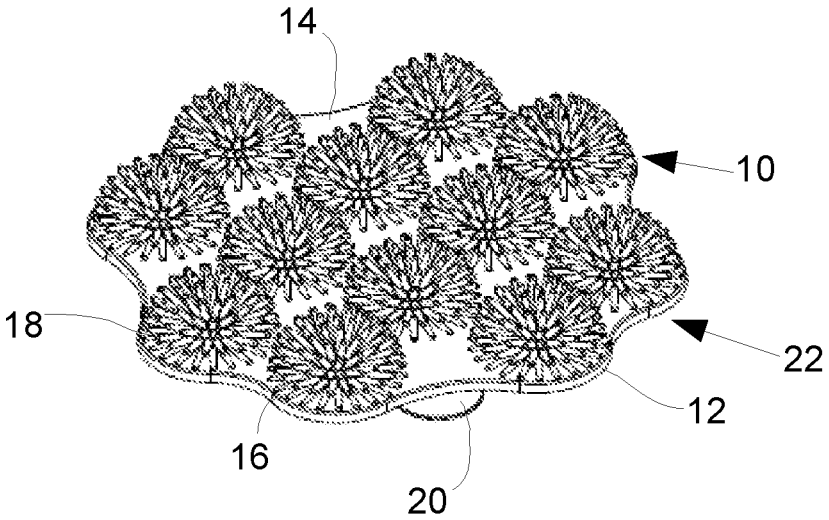
FIG. 1 is a top perspective view of the Hair Removal Device.

Referring to FIG. 1, the hair removal device 10 may comprise a generally flat body 12 having a body top 14 and clusters 16 of tentacles 18. A wall attachment 20 may be on the body 12 opposite the clusters 16. The clusters 16 may be arranged in rows or columns or in a grid type arrangement 22 on the body top 14.

Figure 2:
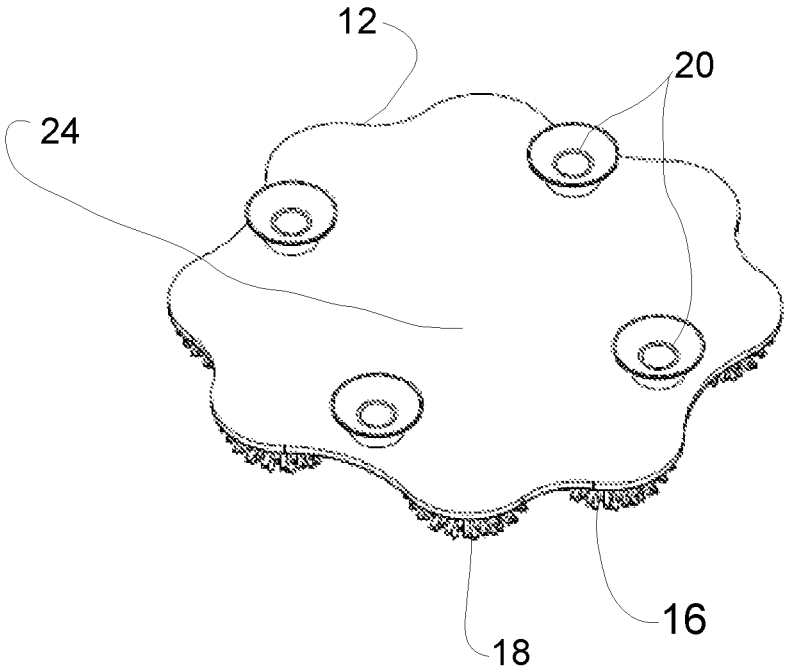
FIG. 2 is a bottom perspective view of the Hair Removal Device of FIG. 1.

Referring to FIG. 2, the body 12 may further comprise a body bottom 24 opposite body top 16. The wall attachment 20 on the body bottom 24. The wall attachment 20 may be a suction cup 26 attached to the base and positioned at a predetermined pattern to accommodate attaching to a variety of surfaces.

Figure 3:
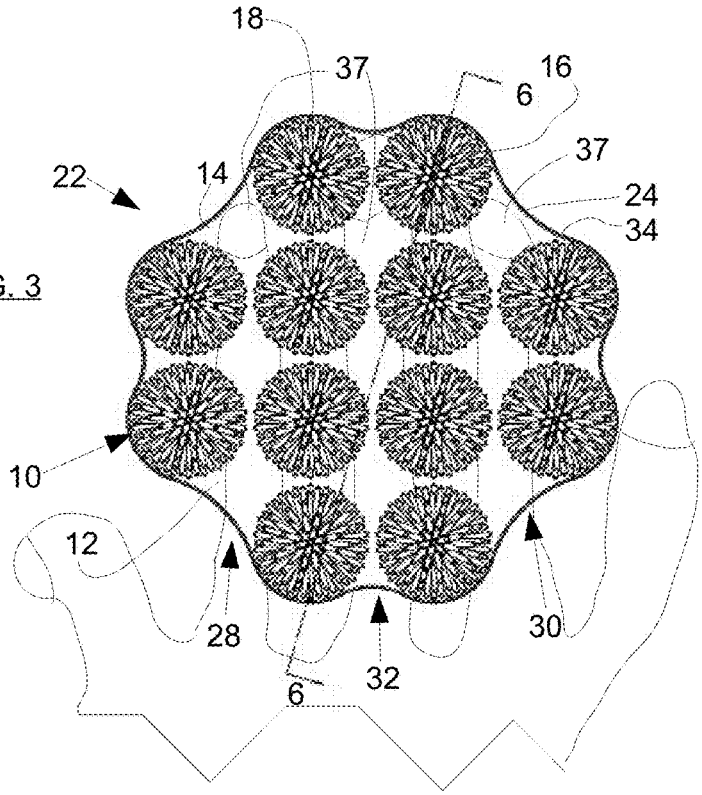
FIG. 3 is a top plan view of the Hair Removal Device of FIG. 1.

Referring to FIG. 3, the clusters 16 may be configured on the body top 14 in a predetermined pattern to create an index finger row 28, a middle finger row 30 and a ring finger row 32. A space 34 may be disposed between clusters 16 to accommodate cleaning and create the rows 28, 30, 32. The clusters 16 may be disposed about the base perimeter 34. A hand 35 having fingers 37 is placed on the Hair removal device. 10 having one finger 37 in each row 28, 30, 32.

Figure 4:
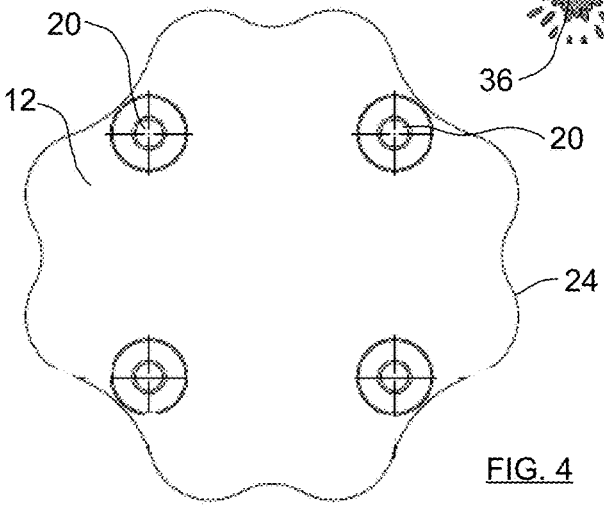
FIG. 4 is a bottom plan view of the Hair Removal Device of FIG. 1.

Referring to FIG. 4, the suction cups 26 may be arranged in a pattern to hold the hair removal device 10 in a predetermined orientation. Suction cups 26 may be disposed opposite clusters 16 (FIG. 1).

Figure 5:
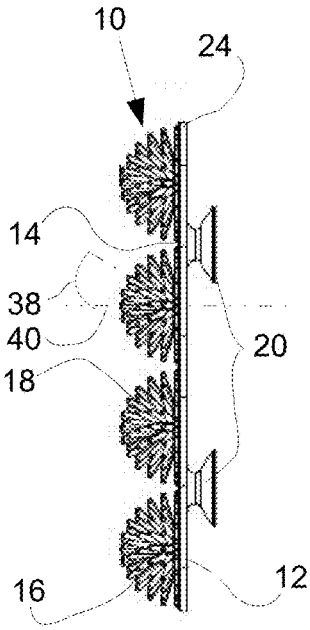
FIG. 5 is a side elevation view of the Hair Removal Device of FIG. 1.

Referring to FIG. 5, clusters 16 and suction cups 26 may be integrally formed on the base 12. Each cluster 16 may have a cluster base 36 having tentacles 18 attached thereto. Each tentacle 18 projects from the body 14 at a predetermined angle 38 to the cluster axis 40. The plurality of tentacles 18 may be distributed to form a semi sphere shaped cluster 16. The cluster 16 may be pyramid shaped, a cube or other predetermined shape. The cluster base 36 attached to the body 14 on the body top 16. Each tentacle 18 having a first end 42 on the cluster base 36 and a hair engagement end 44 spaced from the cluster base 36.

Figure 6:
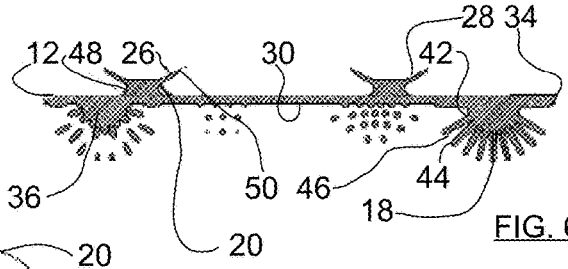
FIG. 6 is a section view of taken at approximately 6-6 of FIG. 3.

Referring to FIG. 6, the hair removal device 10 may have air space 46 between tentacles 18. The tentacles 18 are formed from a flexible material such as latex, rubber or similar resilient material. Tentacle hair engagement end 44 may be suspended in or adjacent to a row 28, 30, 32 on the body top 16. Clusters 16 may be integrally molded with the body 12. Suction cups 26 may be mounted opposite clusters 16 on body 12. Suction cups 26 may further comprise a cup base 48 on the body bottom and a cup 50 on the cup base 48. The cup base 48 is attached to the body 12. The cup 50 is spaced from the body 12. Suction cups 26 may be integrally molded with the base 12 and clusters 16.

In use, the hair removal device 10 may be mounted to a wall or shelf and positioned to receive a user's fingers thereon. The Clusters 16 may be spaced to allow fingers to rub on the base top 14 against tentacles 18. Tentacles 18 deflect to bear against the finger to transfer hair from the hand to the hair removal device 10.

Although the description above contains many specifications, these should not be construed as limiting the scope of the invention but as merely providing illustrations of some of the embodiments of this invention. Thus, the scope of the invention should be determined by the appended claims and their legal equivalents rather than by the examples given. Further, the present invention has been shown and described with reference to the foregoing exemplary embodiments. It is to be understood, however, that other forms, details, and embodiments may be made without departing from the spirit and scope of the invention which is defined in the following claims.

We claim:

1. A hair removal device comprising a body and a plurality of tentacle clusters, the body having a body top and a body bottom, a wall attachment on the body bottom, each of the plurality of tentacle clusters comprising a cluster base and a plurality of tentacles, the cluster base on the body top, each one of the plurality of tentacles comprising a first tentacle end and a second tentacle end, each of the first tentacle ends on the respective cluster base, each of the first tentacle ends spaced from the body top, each of the second tentacle ends spaced from the cluster base, each of the second tentacle ends spaced from the body top, the tentacles extending radially from the cluster base at a variety of angles, the plurality of clusters disposed in a predetermined pattern to create an index finger row, a middle finger row and a ring finger row.

2. The hair removal device of claim 1, wherein the body, wall attachment and plurality of tentacles are integrally molded together.

3. The hair removal device of claim 1, wherein the some of the plurality of tentacle clusters are grouped together between the index finger row and the middle finger row, other of the plurality of tentacle clusters are grouped together between the middle finger row and the ring finger row, each of the plurality of tentacle clusters in spaced relation to the other tentacle clusters.

4. The hair removal device of claim 1, wherein each one of the plurality of tentacles projects radially from the respective cluster base.

5. The hair removal device of claim 4, wherein each second end is in spaced relation to each other second end.

6. The hair removal device of claim 1, wherein the wall attachment further comprises a plurality of suction cups on the body.

7. The hair removal device of claim 6, wherein the plurality of tentacles are integrally molded with the body.

8. The hair removal device of claim 1, wherein the body further comprises a perimeter, the index finger row is disposed on the body top extending from the perimeter.

9. A hair removal device comprising a body, a plurality of tentacle clusters and a plurality of suction cups, the body comprising a perimeter, a body top and a body bottom, the plurality of tentacle clusters on the body top, the plurality of suction cups on the body bottom, each of the plurality of tentacle clusters comprising a cluster base, an axis and a plurality of tentacles, each cluster base on the body top, the cluster base between the body and each one of the plurality of tentacles, the axis generally perpendicular to the base, each of the plurality of tentacles having a first end on the cluster base, a shaft and a second end spaced from the cluster base, the first end spaced from the body top, the shaft of each of the plurality of tentacles oriented radially from the cluster base, each shaft extending from the cluster base at one of a variety of angles to the axis, a plurality of finger rows disposed between some of the plurality of tentacle clusters, the plurality of finger rows on the perimeter, some of the plurality of tentacles extending into one of the plurality of finger rows such that the second end of each of the plurality of tentacles is in spaced relation to the body top.

10. The hair removal device of claim 9, wherein the body, clusters and suction cups are integrally molded together.

11. The hair removal device of claim 10, wherein the clusters are formed of a resilient material.

12. The hair removal device of claim 11, wherein the resilient material is chosen from the group of latex, rubber, vinyl, nitrile, silicone, or neoprene.

13. A hair removal device comprising:

a body having a body top, a perimeter and a body bottom;

a plurality of tentacle clusters, each of the plurality of tentacle clusters having an axis, a cluster base and a plurality of tentacles, each cluster base on the body top, each one of the plurality of tentacles having a first end on the cluster base and a second end spaced from the cluster base, each one of the plurality of tentacles spaced from the body top, each of the plurality of tentacles extending from the cluster base at one of a variety of angles to the axis;

a suction cup, the suction cup having a base and a cup, the base on the body bottom, the cup on the base, the cup spaced from the body bottom; and a plurality of finger rows disposed between adjacent ones of the plurality of tentacle clusters, each one of the plurality of finger rows spaced from each other one of the plurality of finger rows, each of the plurality of finger rows on the perimeter, one of the plurality of tentacle clusters between each one of the plurality of finger rows and the other ones of the plurality of finger rows.

14. The hair removal device of claim 13, wherein each one of the plurality of tentacles extends radially from the respective cluster base whereby each one of the plurality of tentacles extends radially from the respective cluster base at one of a variety of angles to the axis.

* * * * *